United States Patent [19]

Handler

[11] Patent Number: 4,830,528

[45] Date of Patent: May 16, 1989

[54] CLOSURE MECHANISM FOR A LOOSE-LEAF HOLDER

[76] Inventor: Anthony Handler, Mühlbachergasse 14, Vienna, Austria

[21] Appl. No.: 239,501

[22] Filed: Sep. 1, 1988

[51] Int. Cl.[4] ..... B42F 13/20

[52] U.S. Cl. ..... 402/34

[58] Field of Search ..... 402/34, 80 R

[56] References Cited

U.S. PATENT DOCUMENTS

| | | | |
|---|---|---|---|
| 2,519,932 | 8/1950 | Rostoker et al. | 402/34 |
| 2,871,711 | 3/1959 | Stark | 402/34 X |
| 2,894,400 | 7/1959 | Bonn | 402/34 |

*Primary Examiner*—Paul A. Bell

*Attorney, Agent, or Firm*—Kurt Kelman

[57] ABSTRACT

A closure mechanism for a loose-leaf holder for sheets defining holes along an edge thereof comprises a base plate having a stiffening rib extending along an edge of the base plate and flaps stamped out of the base plate and bent upwardly about a common axis. Fixed prongs for receiving the holes of the sheets are fastened to the base plate along an opposite edge of the base plate, and commonly pivotal prongs having a loop portion cooperate with the fixed prongs upon pivoting the prongs into engagement with the fixed prongs. A common carrier plate for the pivotal prongs defines slots receiving the base plate flaps with slight play, the common axis of the flaps extending substantially parallel to the stiffening rib and to a connecting line between the pivotal prongs whereby the common carrier plate with the pivotal prongs is mounted on the base plate for pivoting about the common axis, and the carrier plate has lugs projecting therefrom and facing the stiffening rib, the carrier plate lugs engaging slots in a side wall of the stiffening rib facing the carrier plate with slight play.

5 Claims, 4 Drawing Sheets

CLOSURE MECHANISM FOR A LOOSE-LEAF HOLDER

BACKGROUND OF THE INVENTION (1) Field of the Invention

The present invention relates to a closure mechanism for a loose-leaf holder for sheets defining holes along an edge thereof, comprising a base plate having flaps stamped out of the base plate and bent upwardly about a common axis, fixed prongs for receiving the holes of the sheets fastened to the base plate along an edge of the base plate, commonly pivotal prongs along an opposite base plate edge and having a loop portion cooperating with the fixed prongs upon pivoting the prongs into engagement with the fixed prongs, and a common carrier plate for the pivotal prongs, the carrier plate defining slots receiving the base plate flaps with slight play, the common axis of the flaps extending substantially parallel to a connecting line between the pivotal prongs whereby the common carrier plate with the pivotal prongs is mounted on the base plate for pivoting about the common axis.

(2) Description of the Prior Art

Such a closure mechanism has been disclosed, for example, in German Pat. No. 816,689. The base plate disclosed in this patent has a flat surface, except for two small flaps pivotally mounting the carrier plate on the base plate and an upwardly bent flap supporting an actuating lever of the closure mechanism. The carrier plate for the pivotal prongs is also substantially flat, the carrier plate defining the slots wherein the base plate flaps are engaged. To secure the carrier plate on the base plate, the base plate flaps have bent-over upper ends holding the carrier plate. This, however, does not safely hold the carrier plate on the base plate. Furthermore, the bent-over flaps interfere with the pivoting motion of the carrier plate, particularly if the upper flap ends are bent over to enclose an angle of the order of magnitude of 90° with the base plate in an effort to increase the safety of the connection between the base and carrier plates whereby the play between the carrier plate and the inside of the bent-over flaps is reduced to a minimum. Thus, the safety of the interconnection between the base and carrier plates is proportional to a reduction in the pivoting range of the carrier plate on the base plate. Therefore, the closure mechanism must be manufactured with very close tolerances, which are difficult to attain. In this respect, it must be noted that the flaps are subjected to inner tensions when they are stamped out of the base plate and bent upwardly, which makes the maintenance of the required close tolerances even more difficult.

SUMMARY OF THE INVENTION

It is the primary object of this invention to overcome these disadvantages and to provide a closure mechanism of the indicated type which provides a safe connection between the base and carrier plates, which prevents an unintended disassembly of the plates while a high degree of relative movement therebetween is maintained.

The above and other objects are accomplished in accordance with the invention with a base plate having a stiffening rib extending along an edge of the base plate and parallel to the common axis of the base plate flaps, the carrier plate having lugs projecting therefrom and facing the stiffening rib, the carrier plate lugs engaging slots in a side wall of the stiffening rib facing the carrier plate with slight play.

In this manner, it is possible with very simple means to assure a readily pivotal mounting of the carrier plate on the base plate while, at the same time, a secure connection between the plates is obtained. The mounting can be manufactured in a simple stamping procedure at the same time as the base plate itself is stamped from a sheet of metal. The flaps together with the lugs also serve for positioning the carrier plate in relation to the pivoting axis of the carrier plate as well as perpendicularly thereto, which assures the alignment of the pivotal prongs with the fixed prongs upon pivoting the carrier plate into the closing position wherein the prongs cooperate to hold the sheets against removal. The intersecting base plate flaps and carrier plate lugs along the pivoting axis, together with the stiffening rib in the base plate, securely position the carrier plate on the base plate, the stiffening rib reducing the displaceability of the carrier plate in a direction transversely to the pivoting axis of the carrier plate to a minimum. This makes it possible to bend the upper ends of the base plate flaps only a little above the carrier plate whereby larger tolerances are acceptable while assuring a large measure of safety against unintended disassembly of the carrier plate from the base plate.

In addition, the provision of the stiffening rib on the base plate makes it possible to use thin-gaged sheet metal without reducing the rigidity of the closure mechanism. The stiffening rib also provides an abutment for the carrier plate, which makes it possible to use the very simple pivotal mounting provided by the present invention.

The arrangement of the base plate flaps in this pivotal mounting provides a notched meshing of the carrier plate with the base plates so that a displacement of the carrier plate is securely prevented when the flaps are bent over after the carrier plate is engaged with the base plate flaps. This reduces rejects to a minimum even in a fully automatic assembly operation for manufacturing the closure mechanism in a conventional assembly line.

BRIEF DESCRIPTION OF THE DRAWING

The above and other objects, advantages and features of the invention will become more apparent from the following description of a now preferred embodiment thereof, taken in conjunction with the accompanying schematic drawing wherein.

DETAILED DESCRIPTION OF PREFERRED EMBODIMENT

Figure 1:
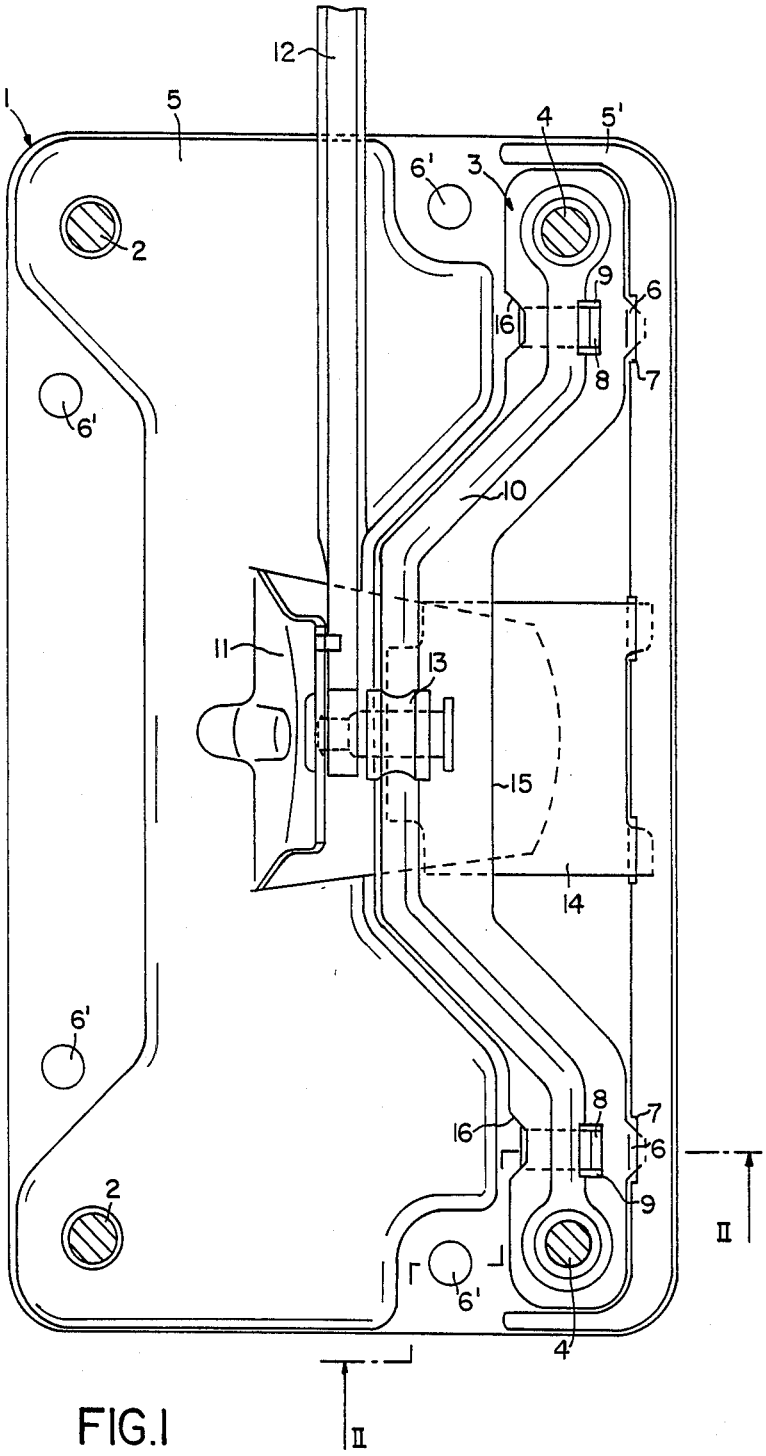
FIG. 1 is a top view of a closure mechanism of a loose-leaf holder for sheets defining holes along an edge thereof, the prongs being shown in transverse cross section.

The drawing shows base plate 1 for a closure mechanism of a loose-leaf holder for sheets defining holes along an edge thereof. The base plate carries two fixed prongs 2 for receiving the holes of the sheets (not shown) and two pivotal prongs 4 cooperating with the fixed prongs.

Figure 2:
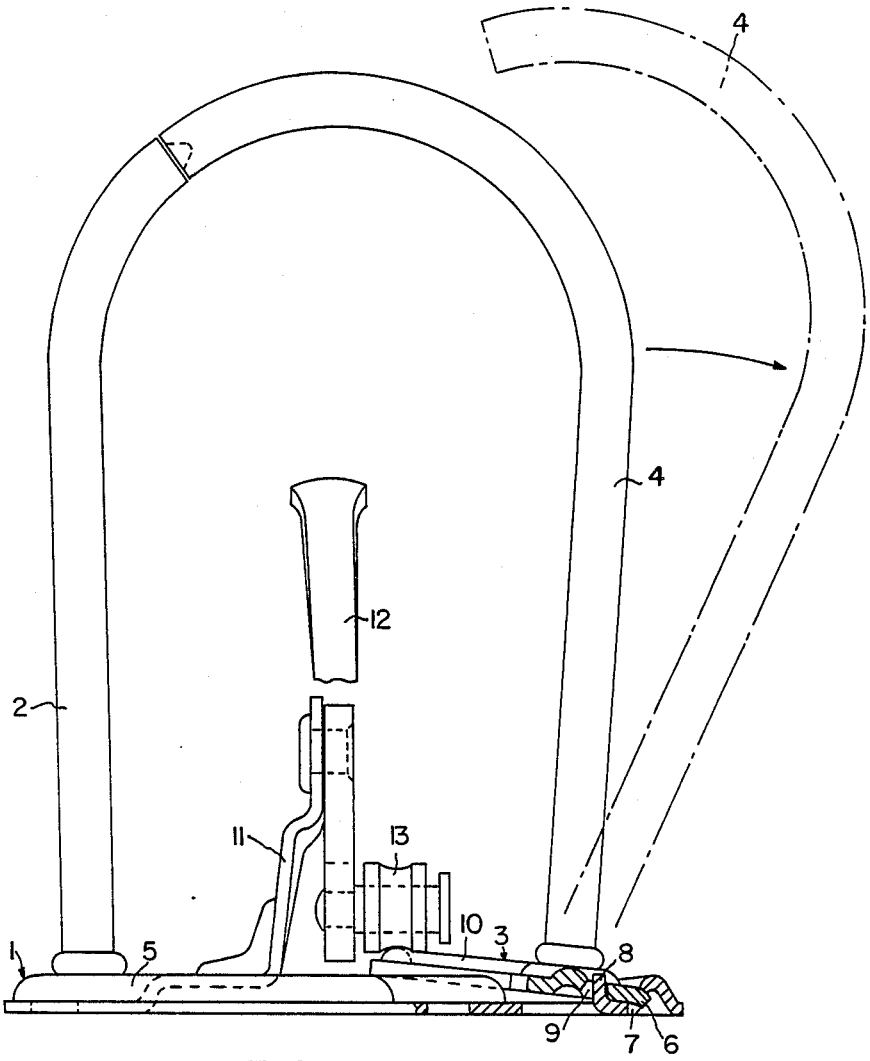
FIG. 2 is a side view of FIG. 1.
Figure 3:
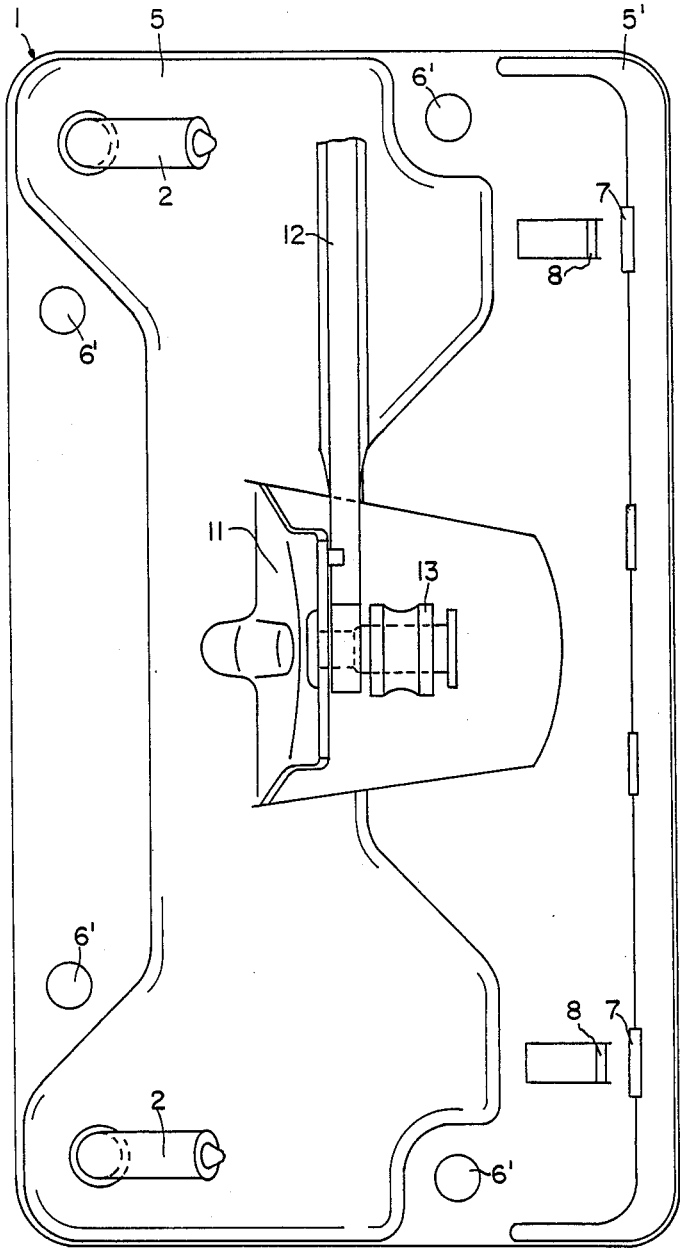
FIG. 3 is a top view of the base plate.

As illustrated, base plate 1 has a stiffening rib 5 extending over the larger part of the base plate, an additional stiffening rib 5' extending along an edge of the base plate and flaps 8 stamped out of base plate 1 and bent upwardly about a common axis. Stiffening rib 5 leaves free a space for bores 6' designed to receive fastening elements, such as rivets, and also carrier plate 3 which is positioned on base plate 1 between stiffening ribs 5 and 5'. Fixed prongs 2 for receiving the holes of the sheets (not shown) are fastened to the base plate along an opposite edge of the base plate, and commonly pivotal prongs 4 having a loop portion cooperate with the fixed prongs upon pivoting the prongs into engagement with the fixed prongs. Common carrier plate 3 for pivotal prongs 4 defines slots 9 receiving base plate flaps 8 with slight play, the common axis of the flaps extending substantially parallel to stiffening rib 5' and to a connecting line between pivotal prongs 4 whereby common carrier plate 3 with pivotal prongs 4 is mounted on base plate 1 for pivoting about the common axis. The carrier plate has lugs 6 projecting therefrom and facing stiffening rib 5', the carrier plate lugs engaging slots 7 in a side wall of stiffening rib 5' facing carrier plate 3 with slight play, the lug thus subtending the web which forms this stiffening rib (see FIG. 2). Lug 6 and slot 7 are so dimensioned that the lug has little play in the slot.

To mount carrier plate 3 on base plate 1, webs or flaps 8 are stamped out of the base plate and bent upwardly. The upwardly bent webs or flaps 8 are engaged in slots 9 of carrier plate 3, which produces a pivotal mounting of the carrier plate on the base plate. The carrier plate may be disassembled from the base plate by lifting it out of upwardly bent webs or flaps 8 and simultaneously pulling lug 6 out of slot 7 of stiffening rib 5'. If disassembly of the carrier plate from the base plate is to be prevented, the upper ends of webs or flaps 8 may be bent over in the direction of stiffening rib 5' after the carrier plate has been placed on the base plate so that a lifting of the carrier plate is impossible.

Base plate flaps 8 have upper ends projecting above the carrier plate, the upper ends of the flaps being bent over the carrier plate towards stiffening rib 5' after carrier plate 3 has been placed on base plate 1, which prevents a subsequent lifting of the carrier plate off the base plate and assures a proper mounting of the carrier plate. Carrier plate 10 also has a stiffening rib 10 of trapezoidal cross section whose web is pierced by the two pivotal prongs 4 which are affixed to the carrier plate. This serves not only to stiffen the carrier plate but also provides space for forming rivet heads for prongs 4 at the underside of the carrier plate for fastening the prongs thereto. Fixed prongs 2 are similarly riveted to base plate 1 in the range of stiffening rib 5.

As is conventional, holding element 11 is stamped out of base plate 1 and is bent upwardly. The holding element serves as support for the mounting of closing lever 12 carrying roller 13 which contacts upwardly projecting stiffening rib 10 of carrier plate 3. In the closing position of the closure mechanism, lever 12 with roller 13 presses carrier plate 3 down against the bias of leaf spring 14 held on base plate 1 in engagement with the underside of the carrier plate. The illustrated trapezoidal portion 15 of spring 14, which engages carrier plate 3, provides a relatively good lever ratio although pivotal carrier plate 3 is relatively small.

To avoid waste of material when carrier plate 3 is stamped out of a metal sheet, the two edges of the carrier plate form a slot and key image at respective sides of the pivoting axis defined by slots 9. Thus, recesses 16 at the carrier plate edge on one side of the pivoting axis correspond exactly to lugs 6 at the opposite carrier plate edge, as shown in FIG. 1. Also, the two carrier plate edges extending parallel to the one base plate edge have the same length adjacent substantially trapezoidal spring portion 15, all the lengths of the individual sections of the carrier plate edges at respective sides of stiffening rib 10 being of the same length so that carrier plates 3 may be abuttingly place side-by-side in the plane thereof without leaving any free spaces therebetween. This enables the available sheet metal raw material to be utilized to a maximum extent.

Figure 4:
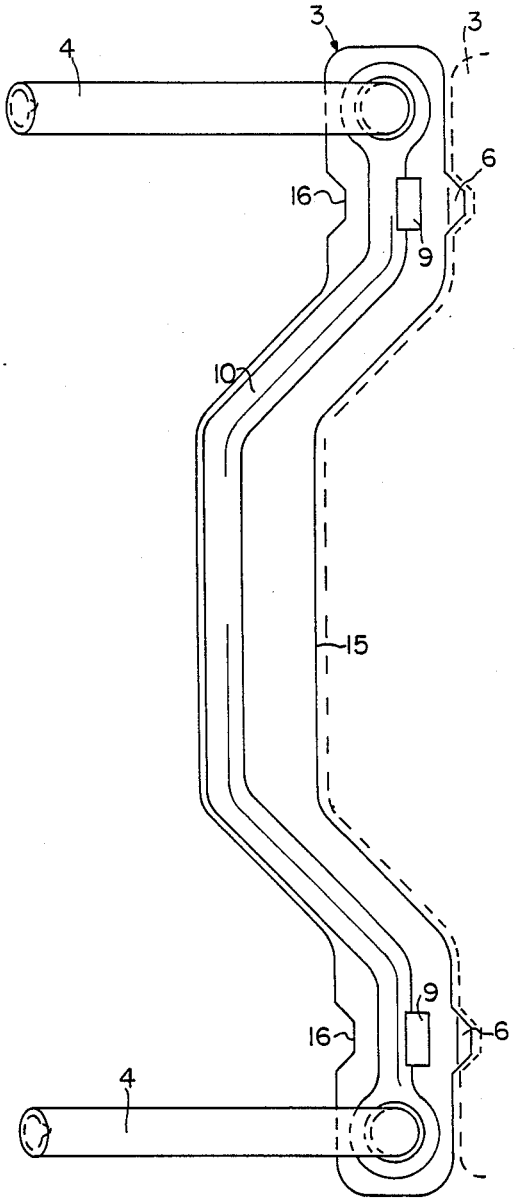
FIG. 4 is a top view of the carrier plate.

With a carrier plate having central protruding portion 15 coplanar therewith and the edges of two carrier plates 3 abuttingly arrayed transversely thereto and extending substantially in the direction of the connecting line between pivotal prongs 4 forming a slot and key image. Therefore practically no sheet material will be wasted when the plates are stamped out as two [carrier plates 3 abuttingly arrayed transversally to the connecting lines between their pivotal prongs form in the main e slot and key image (FIG. ). To show said leakage the left conture of a further carrier plate 3 is shown in FIG. 4 with dashed lines.]Providing carrier plate 3 with protruding portion 15 enables the carrier plate to be kept relatively narrow while providing sufficient leverage for a spring engaging the protruding carrier plate portion and biasing the carrier plate with prongs 4 into an open position of the closure mechanism.

What is claimed is:

1. A closure mechanism for a loose-leaf holder for sheets defining holes along an edge thereof, which comprises (a) a base plate having
  (1) a stiffening rib extending along an edge of the base plate and
  (2) flaps stamped out of the base plate and bent upwardly about a common axis, (b) fixed prongs for receiving the holes of the sheets fastened to the base plate along an opposite edge of the base plate, (c) commonly pivotal prongs having a loop portion cooperating with the fixed prongs upon pivoting the prongs into engagement with the fixed prongs, and (d) a common carrier plate for the pivotal prongs,
  (1) the carrier plate defining slots receiving the base plate flaps with slight clearance, the common axis of the flaps extending substantially parallel to the stiffening rib and to a connecting line between the pivotal prongs whereby the common carrier plate with the pivotal prongs is mounted on the base plate for pivoting about the common axis, and
  (2) the carrier plate having lugs projecting therefrom and facing the stiffening rib, the carrier plate lugs engaging slots in a side wall of the stiffening rib facing the carrier plate with slight clearance.

2. The closure mechanism of claim 1, wherein the base plate flaps have upper ends projecting above the carrier plate, the upper ends of the flaps being bent over towards the stiffening rib.

3. The closure mechanism of claim 1, wherein the carrier plate has a central protruding portion coplanar therewith, and two carrier plates abuttingly arrayed transversely thereto form in the main a slot and key image.

4. The closure mechanism of claim 3, wherein the central carrier plate protruding section is substantially trapezoidal.

5. The closure mechanism of claim 1, wherein the carrier plate has a stiffening rib of substantially trapezoidal cross section, the stiffening rib of the carrier plate having a web through which the pivotal prongs extend.

* * * * *